US006682002B2

(12) United States Patent
Kyotani

(10) Patent No.: US 6,682,002 B2
(45) Date of Patent: Jan. 27, 2004

(54) EJECTOR

(75) Inventor: Takashi Kyotani, Kanagawa (JP)

(73) Assignee: Ebara Corporation, Tokyo (JP)

( * ) Notice: Subject to any disclaimer, the term of this patent is extended or adjusted under 35 U.S.C. 154(b) by 328 days.

(21) Appl. No.: 09/924,554

(22) Filed: Aug. 9, 2001

(65) Prior Publication Data

US 2002/0030121 A1 Mar. 14, 2002

(30) Foreign Application Priority Data

Aug. 11, 2000 (JP) ..... 2000-244356

(51) Int. Cl.[7] ..... B05B 7/30

(52) U.S. Cl. ..... 239/318; 239/104; 239/106; 239/108; 239/112; 239/310; 239/398

(58) Field of Search ..... 239/104, 106, 239/108, 112, 310, 311, 314, 318, 398, 418, 421, 423, 433, 434

(56) References Cited

U.S. PATENT DOCUMENTS 4,543,900 A 10/1985 Aker
4,673,335 A 6/1987 Nicodemus
5,915,592 A * 6/1999 Mehus et al. ..... 239/318
5,960,887 A * 10/1999 Crabtree ..... 239/318

FOREIGN PATENT DOCUMENTS

DE 26 22 076 12/1976
GB 1 548 137 7/1979

* cited by examiner

*Primary Examiner*—Robin O. Evans
(74) *Attorney, Agent, or Firm*—Wenderoth, Lind & Ponack, L.L.P.

(57) ABSTRACT

An ejector is provided with an interior surface wetting device for introducing a cleaning liquid into a suction chamber of the ejector to form a thin wall of the cleaning liquid covering an interior surface of the ejector. The interior surface wetting device includes a cleaning liquid inlet opening to be fluidly connected to a source of cleaning liquid and a cleaning liquid outlet opening for introducing the cleaning liquid into a suction chamber. The wetting device may be in the form of a pipe which extends from the outside of the ejector into the suction chamber to supply a cleaning liquid to a desired portion in the suction chamber.

12 Claims, 4 Drawing Sheets

EJECTOR

BACKGROUND OF THE INVENTION

The present invention relates to an ejector for drawing a fluid to be removed by using a negative pressure.

An ejector of the present art typically has a chamber provided with a fluid intake opening through which a fluid is drawn under suction, and a nozzle for directing a jet of fluid towards an outlet opening of the chamber. When the jet entrains a fluid in the chamber and expels it via the outlet opening, a negative pressure is created in the chamber.

FIG. 1 shows such an ejector. As shown, the ejector includes an ejector body 10 having a suction chamber 1. The ejector body has a jet nozzle portion 2, a tubular fluid inlet portion 3 and a tubular fluid outlet portion or diffuser portion 4. The nozzle portion 2 is connected to a drive fluid introduction pipe 5 which is in turn connected to a high pressure drive fluid source (not shown). In operation, drive fluid Q1 in jet form is discharged into the suction chamber 1 from the nozzle portion 2 towards the diffuser portion 4. The jet of the drive fluid Q1 moves out of the suction chamber 1 through the diffuser portion 4, thereby creating a negative pressure in the suction chamber 1; as a result, fluid Q2 is drawn into the suction chamber 1 through the tubular fluid inlet portion 3 and, then, discharged from the suction chamber 1 through the diffuser portion 4.

One drawback of this arrangement is the likelihood that solid material present in the form of fumes or mist in an entrained fluid Q2 will be deposit on surfaces of suction chamber 1, diffuser portion 4 and/or nozzle portion 2. Such deposition of material, particularly if it occurs on the surface of an inlet passage portion 6 of diffuser portion 4, will substantially reduce suction capability of the ejector.

This deposition problem is also liable to occur when a solid material is created by reaction of a material in fluid Q2 with drive fluid Q1. For example, in the case that the fluid Q2 is a gas containing boron trichloride ($BCl_3$) which is strongly reacts with water, and fluid Q1 is air containing moisture, a reaction between boron trichloride in fluid Q2 and moisture in fluid Q will produce hydrochloric acid (HCl) in gas form and boric oxide ($B_2O_3$) in solid form. Consequently, boric oxide thus produced is liable to adheres to the interior surfaces of the ejector. Similarly, when fluid Q2 contains a material such as silicon tetrachloride ($SiCl_4$) or titanium tetrachloride ($TiCl_4$) which are strongly reactive with water, a solid material will be formed by reaction.

In such conventional ejectors, therefore, it has been necessary to periodically disassemble and clean the ejector, thus preventing operation in the apparatus in which it is housed. To overcome this problem, it has been proposed that an ejector be provided with a water cleaning mechanism, whereby it can be cleaned of solid deposits without the need for disassembly. While such a water cleaning mechanism avoids the problems of disassembly, when using it to clean an ejector housed in an assembly, operation of the assembly must still be halted.

The present invention has been made with a view to overcoming these problems.

SUMMARY OF THE INVENTION

In accordance with the present invention, there is provided an ejector which is characterized by being provided with an interior surface wetting device. The interior surface wetting device comprises a cleaning liquid inlet opening to be fluidly connected to a source of a cleaning liquid, and a cleaning liquid outlet opening for introducing the cleaning liquid into a suction chamber of the ejector in such a way as to form a thin wall of the cleaning liquid over an interior surface of the suction chamber and/or an interior surface of the fluid outlet of the ejector. The interior surface wetting device may include a cleaning liquid introduction pipe which is provided in place of or in addition to the cleaning liquid inlet and outlet openings stated above to introduce the cleaning liquid into the suction chamber in such a way as to form a thin wall of the cleaning liquid over the interior surface of the ejector.

By forming a thin wall of cleaning liquid on the interior surface of the ejector, deposition of solid material thereon can be prevented. Incidentally, cleaning liquid may be any kind of liquid such as water and chemical solution which functions to prevent deposition of solid material.

The above and other objects, features and advantages of the present invention will become apparent from the following description of the preferred embodiments when taken in conjunction with the accompanying drawings.

DETAILED DESCRIPTION OF THE INVENTION

Figure 1:
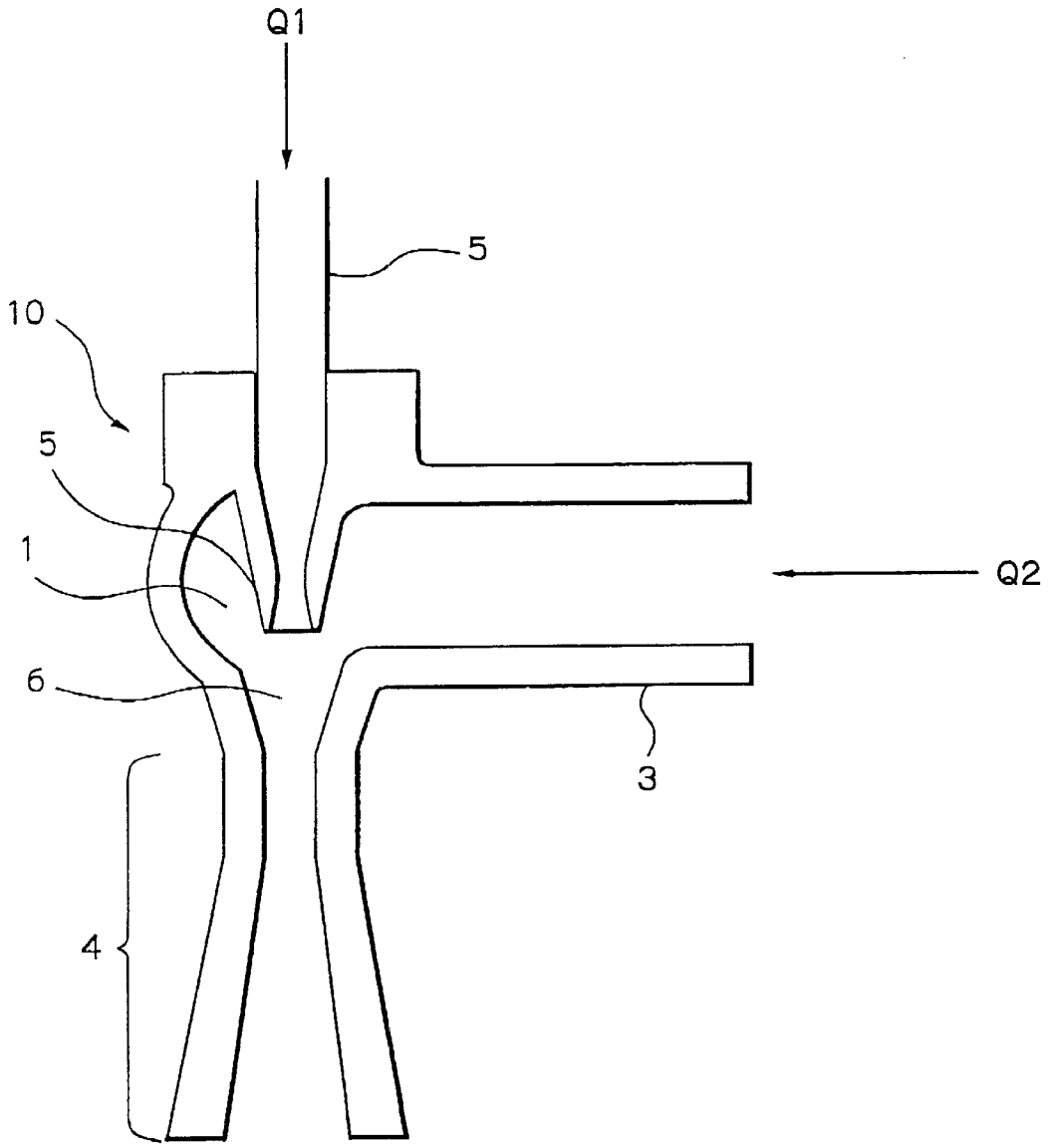
Fig. 1 (PRIOR ART)
FIG. 1 is a schematic cross-sectional view of a prior art ejector.

Preferred embodiments of the present invention will now be explained with reference to the drawings. In these embodiments, like reference numerals denote like members.

Figure 2:
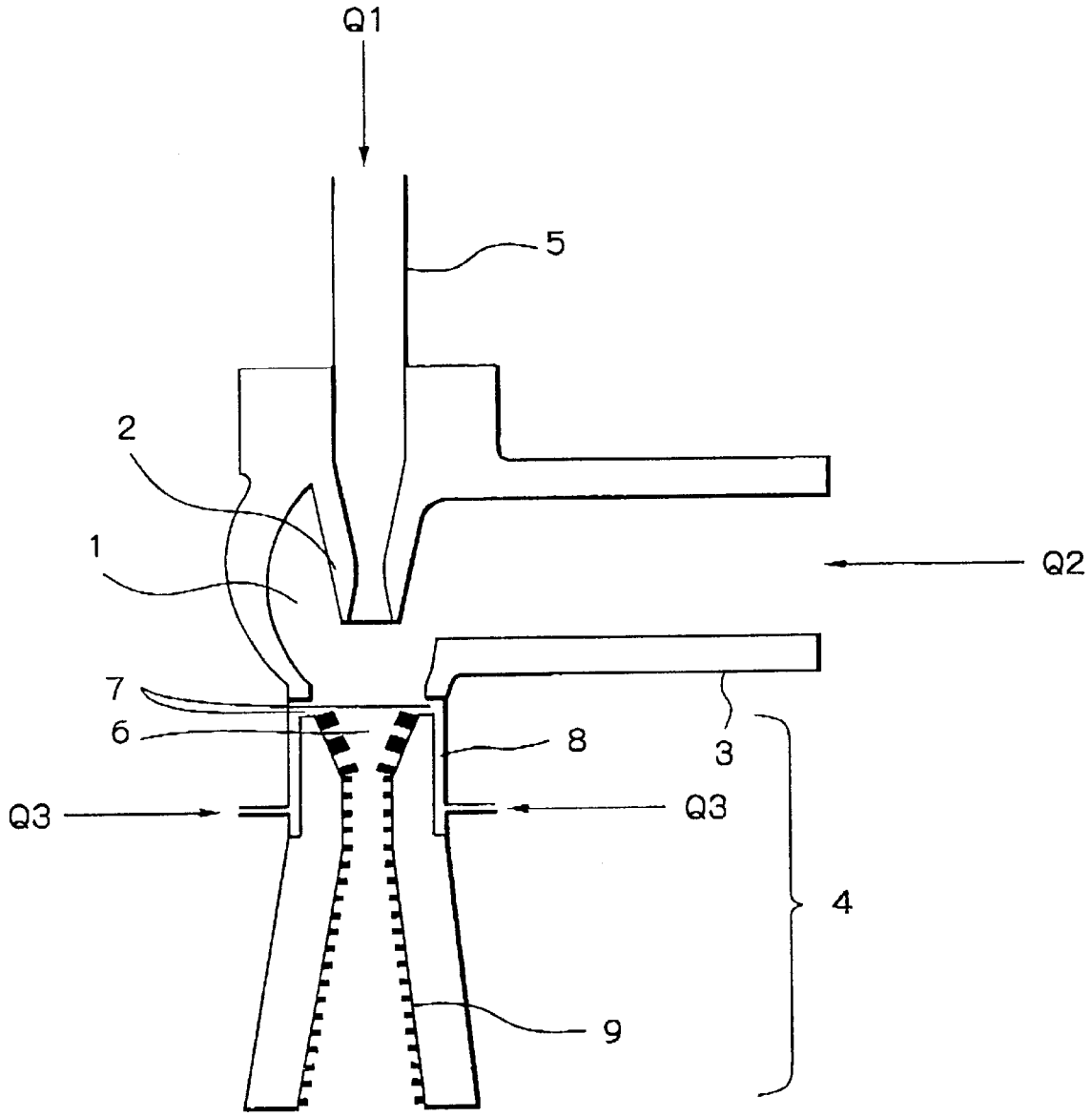
FIG. 2 is a schematic cross-sectional view of an ejector in accordance with a first embodiment of the present invention.

FIG. 2 illustrates an ejector in accordance with a first embodiment of the present invention. As shown, the ejector has generally the same construction of that of the prior art ejector shown in FIG. 1. The ejector is characterized by being provided with an interior surface wetting device for wetting an interior wall of a diffuser portion 4. The interior surface wetting device includes an annular cleaning liquid chamber member 8 provided on an exterior surface of an upper end portion of the diffuser portion 4, inside of which a fluid inlet passage portion 6 is formed. The liquid chamber member 8 has cleaning liquid inlet openings for receiving cleaning liquid Q3, and an annular fluid outlet opening 7 for discharging the cleaning liquid Q3 into the diffuser portion 4 in such a manner that the liquid Q3 flows down along the interior surface of the fluid inlet passage portion 6. Reference numeral 9 denotes a thin wall of the cleaning liquid formed over the interior surface of the diffuser portion 4.

In operation, a jet of drive fluid Q1 is discharged from a nozzle portion 2 into a suction chamber 1 towards diffuser portion 4 to create a fluid flow in a direction out of the suction chamber 1 through diffuser portion 4 to the outside of the ejector. Under the action of this fluid flow, liquid Q2 is drawn into suction chamber 1 and discharged to its outside through diffuser portion 4. During movement of liquid Q2, solid material contained in it may be deposited on the interior surface of the ejector. Such deposition tends to be pronounced around inlet passage portion 6 of diffuser portion 4; with other portions of the interior surface of the ejector being less affected. However, in this embodiment, the thin wall 9 of cleaning liquid formed over the interior wall of the diffuser portion 4 is able to prevent solid material from being deposited on the interior surface of inlet passage portion 6 of the diffuser portion 4 as well as the interior surface of the other passage portion of the same downstream of the inlet passage portion 6.

Preferably the liquid Q3 not only prevents deposition of solid materials by a washing action, but is also capable of chemically dissolving such materials. Thus, if liquid Q2 contains polystyrene particles for example, if liquid Q3 comprises xylene, liquid Q3 will be able to both mechanically and chemically prevent deposition of polystyrene particles on an interior surface of an ejector. Similarly, if liquid Q2 contains tungstic acid ($H_2WO_4$) which has low solubility in water, if liquid Q3 contains sodium hydroxide (NaOH), tungstic acid in liquid Q2 will be converted to water soluble sodium tungstate ($NaWO_4$).

A flow rate of cleaning liquid Q3 can be set optimally depending on a configuration of the ejector and/or a flow rate of liquid Q2. It should be noted that if a flow rate of cleaning liquid Q3 Is too low, cleaning efficiency will be reduced: whereas if the flow rate is too high, excess cleaning liquid Q3 will form thin wall 9, thereby causing an undesirable decrease in suction capability of the ejector.

Preferably, the interior surface of diffuser portion 4 has a symmetrical cross section which is normal to a vertical center axis of a jet of fluid Q1, with the interior surface being made sufficiently smooth to enable a stable flow of of cleaning liquid Q3.

Figure 3:
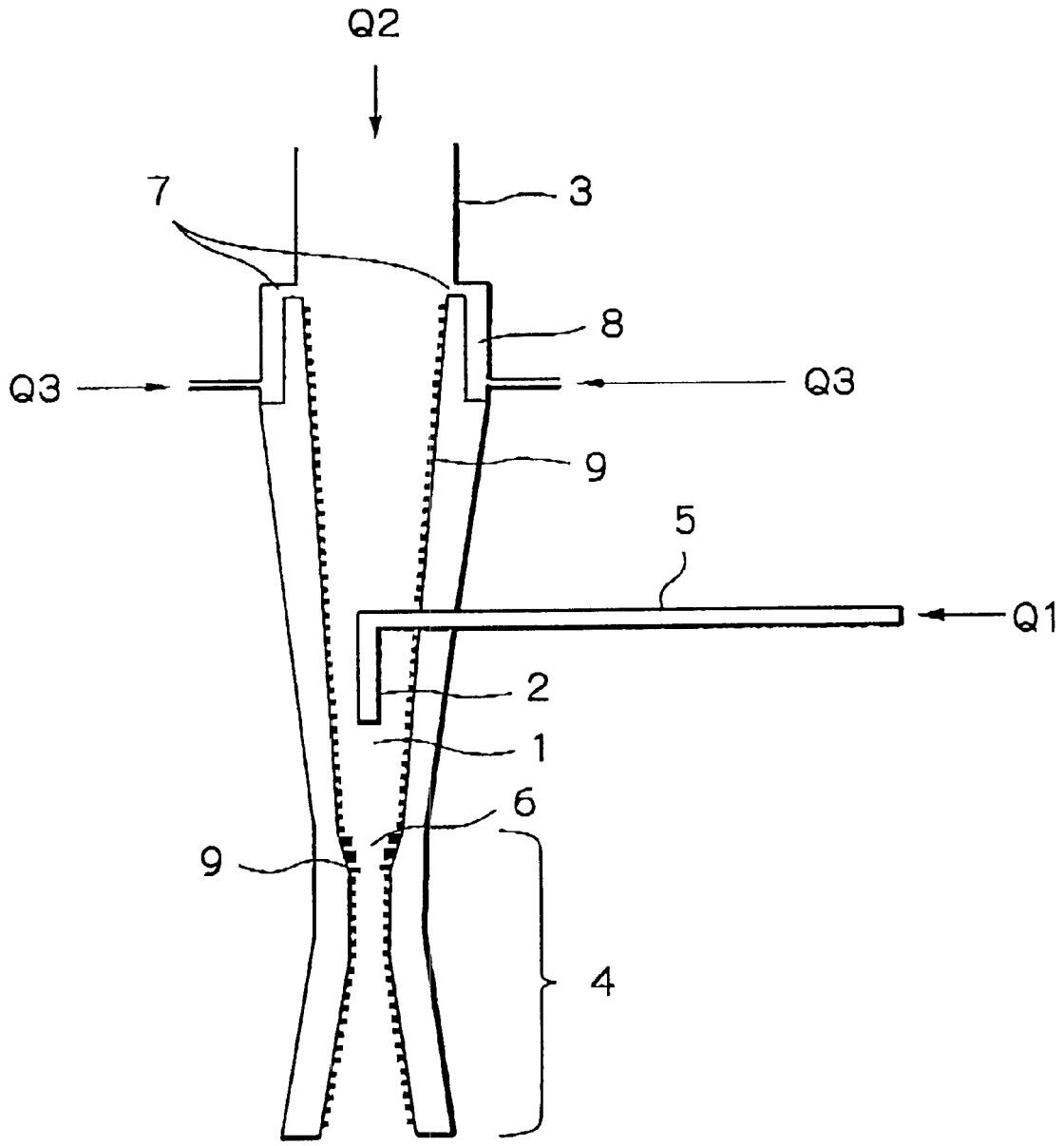
FIG. 3 is a schematic cross-sectional view of an ejector in accordance with a second embodiment of the present invention.

FIG. 3 shows an ejector in accordance with a second embodiment of the present invention.

As shown, the ejector has a vertically extending elongated suction chamber 1 and is provided at its upper end with a tubular fluid inlet portion 3 for introducing a liquid Q2; while at its lower position it is provided with a nozzle 2. This nozzle 2 is connected to a drive fluid introduction pipe 5 which extends horizontally. In the ejector, an annular cleaning liquid chamber member 8 is provided at the upper end of the suction chamber 1, and has an annular fluid discharge opening 7 formed along an upper end edge of the suction chamber 1. Thus, a thin wall 9 of a cleaning liquid Q3 can be formed to cover an entire interior surface of the ejector, including an interior surface of a diffuser portion 4 provided at a lower end of the suction chamber.

Figure 4:
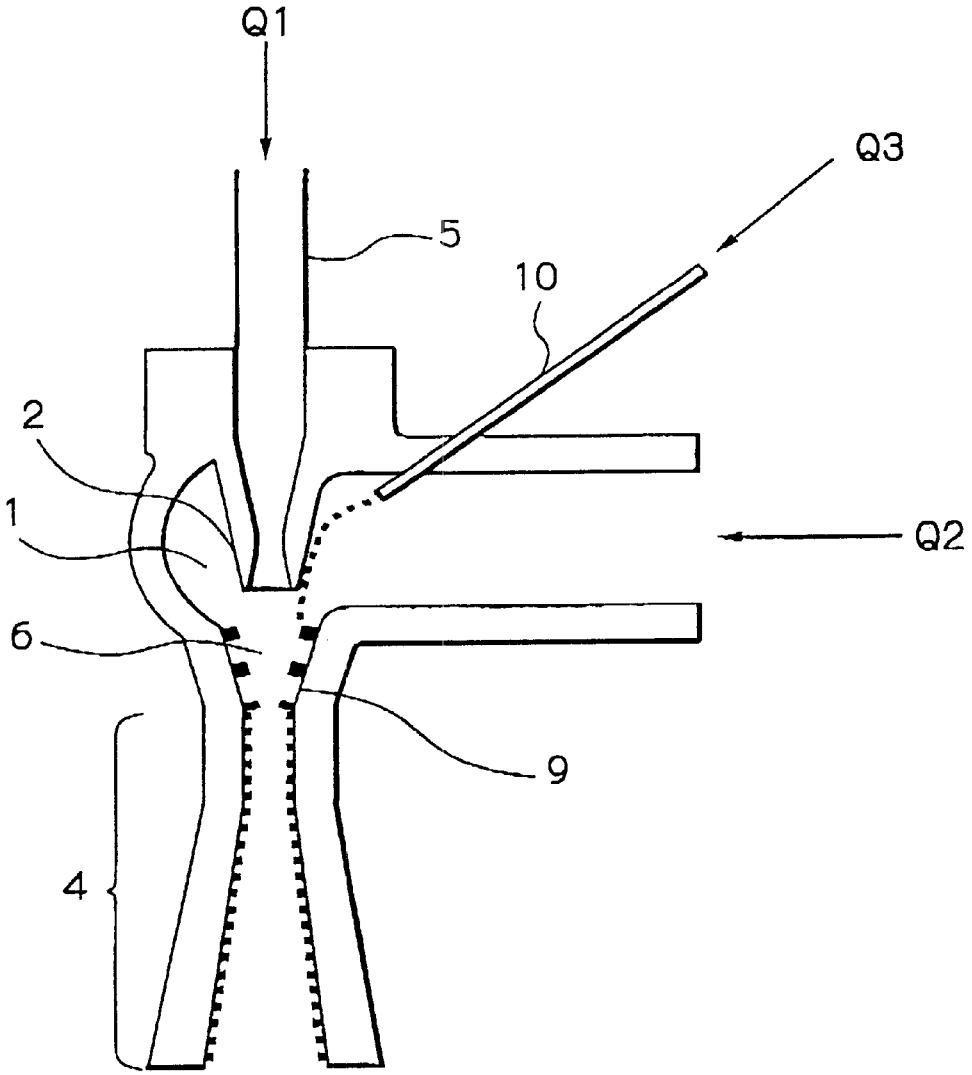
FIG. 4 is a schematic cross-sectional view of an ejector in accordance with a third embodiment of the present invention.

FIG. 4 shows a third embodiment of an ejector of the present invention. As shown, the ejector has generally the same construction as that shown in FIG. 1 except for the provision of an interior surface wetting device. This device comprises at least one cleaning liquid introduction pipe 10 for introducing a cleaning liquid Q3 into a suction chamber 1 of the ejector, such that the cleaning liquid Q3 impinges on a nozzle portion 2. By this arrangement it is possible to avoid solid material in liquid Q2 from being deposited on an outer surface of the nozzle portion 2. The cleaning liquid falls onto an upper part of a fluid inlet passage portion 6 of a diffuser portion 4. Since the fluid inlet passage portion 6 is tapered in a downward direction, if a momentum is imparted to the cleaning liquid in a tangential direction relative to the fluid inlet passage portion 6, the liquid will swirl about a vertical center axis of the fluid inlet passage portion 6 when flowing down along the interior surface of the fluid inlet passage portion 6. As a result, a thin wall 9 of cleaning liquid Q3 is formed over an entire interior surface of the diffuser portion 4. The cleaning liquid introduction pipe 10 can be provided at its tip end with a spray nozzle for supplying cleaning liquid Q3 over a wide area across the interior surface of the ejector. Further, additional cleaning liquid introduction pipes can be provided in such a manner as to direct cleaning liquid Q3 to particular areas of the interior surface of the ejector, for example, those areas on which deposition of solid material readily occurs.

It should be noted that the present invention is not necessarily limited to the foregoing embodiments but can be modified in a variety of ways without departing from the gist of the present invention. For example, in the aforementioned embodiments, cleaning liquid Q3, may be a steam supplied into the suction chamber 1 through the nozzle portion 2 together with the drive fluid Q1. A cleaning liquid in steam form may be condensed when being discharged from the nozzle portion due to lowering of temperature thereof by adiabatic expansion in the suction chamber 1 and/or by mixing with the liquid Q2, thereby forming a thin wall 9 of cleaning liquid Q3 on the interior surface of the ejector. Further, a cleaning liquid introduction pipe 10 as shown in FIG. 4 may be additionally employed in an embodiment as shown in FIG. 2 to form a thin wall 9 of cleaning liquid over the exterior surface of the nozzle portion 2.

What is claimed is:

1. An ejector comprising:

an ejector body having a suction chamber therein, a fluid outlet for allowing a fluid in the suction chamber to exit the suction chamber and a fluid inlet for allowing a fluid to flow into the suction chamber, a nozzle provided in the suction chamber for directing a jet of a drive fluid towards the fluid outlet to induce a flow of fluid exiting the suction chamber through the fluid outlet, thereby creating a negative pressure in the suction chamber, and an interior surface wetting device provided on the ejector body, the interior surface wetting device comprising a cleaning liquid inlet opening to be fluidly connected to a source of cleaning liquid and a cleaning liquid outlet opening for introducing the cleaning liquid into the suction chamber to form a thin wall of the cleaning liquid covering an interior surface of the suction chamber and/or an interior surface of the fluid outlet.

2. An ejector as set forth in claim 1, wherein the fluid outlet comprises a converging inlet passage portion, a restricted passage portion and a diverging passage portion which are successively formed in that order in a downward direction.

3. An ejector as set forth in claim 2, wherein the cleaning outlet opening is an annular slit formed coaxially with the converging inlet passage at or adjacent to a border line between the converging inlet passage portion and the suction chamber.

4. An ejector as set forth in claim 1 wherein the fluid inlet and outlet are provided at upper and lower positions of the suction chamber, respectively, and the cleaning liquid outlet opening is positioned adjacent to the fluid inlet.

5. An ejector as set forth in claim 4, wherein the ejector body has a side cylindrical wall extending between the fluid inlet and outlet and defining the suction chamber, the ejector further comprises a drive fluid introduction pipe extending into the suction chamber through the side wall, and the nozzle is provided at a tip end of the drive fluid introduction pipe to direct the jet of the drive fluid downwardly towards the fluid outlet.

6. An ejector as set forth in claim 1, wherein the interior surface wetting device further comprises a cleaning liquid introduction pipe extending from the outside of the ejector body into the suction chamber such that the cleaning liquid introduction pipe introduces a cleaning liquid into the suction chamber to form a thin wall of the cleaning liquid over an interior surface of the suction chamber.

7. An ejector as set forth in claim 6, wherein the cleaning liquid introduction pipe is arranged to supply the cleaning liquid to an exterior surface of the nozzle.

8. An ejector as set forth in claim 7, wherein the fluid outlet of the suction chamber comprises a converging inlet passage portion, a restricted passage portion and a diverging passage portion which are successively formed in that order in a downward direction, and the nozzle and the fluid outlet of the suction chamber are arranged such that the cleaning fluid supplied to the exterior surface of the nozzle drops onto an interior surface of the converging inlet passage portion of the fluid outlet.

9. An ejector comprising:

an ejector body having a suction chamber therein, a fluid outlet for allowing a fluid in the suction chamber to exit the suction chamber and a fluid inlet for allowing a fluid to flow into the suction chamber a nozzle provided in the suction chamber for directing a jet of a drive fluid towards the fluid outlet of the suction chamber to induce a flow of fluid exiting the suction chamber through the fluid outlet, thereby creating a negative pressure in the suction chamber, and an interior surface wetting device having a cleaning liquid introduction pipe extending from an outside of the ejector body into the suction chamber such that the cleaning liquid introduction pipe introduces a cleaning liquid into the suction chamber to form a thin wall of the cleaning liquid over an interior surface of the suction chamber and/or an interior surface of the fluid outlet.

10. An ejector as set forth in claim 9, wherein the cleaning liquid introduction pipe directs the cleaning liquid to an exterior surface of the nozzle.

11. An ejector as set forth in claim 10, wherein the nozzle and the fluid outlet of the suction chamber are arranged such that the cleaning fluid drops from the nozzle onto an interior surface of the fluid outlet.

12. An ejector as set forth in claim 11, the fluid outlet of the suction chamber comprises a converging inlet passage portion, a restricted passage portion and a diverging passage portion which are successively formed in that order in a downward direction, and the nozzle and the fluid outlet of the suction chamber are arranged such that the cleaning fluid drops from the nozzle onto an interior surface of the converging inlet passage portion of the fluid outlet.

* * * * *